US006244972B1

(12) United States Patent
Drossos

(10) Patent No.: US 6,244,972 B1
(45) Date of Patent: Jun. 12, 2001

(54) PUTTER HEAD HAVING ELASTOMERIC CORE

(76) Inventor: William Drossos, 1206 Duncan Ave., Penticton, British Columbia (CA), V2A 2X2

( * ) Notice: Subject to any disclaimer, the term of this patent is extended or adjusted under 35 U.S.C. 154(b) by 0 days.

(21) Appl. No.: 09/538,265

(22) Filed: Mar. 30, 2000

Related U.S. Application Data

(60) Provisional application No. 60/127,615, filed on Apr. 1, 1999.

(51) Int. Cl.[7] ..... A63B 69/36; A63B 53/04

(52) U.S. Cl. ..... 473/224; 473/251; 473/340; 473/342; 473/349; 473/332

(58) Field of Search ..... 473/324, 332, 473/342, 329, 340, 224, 234, 349, 350, 347, 326, 219, 226, 131, 223, 251, 252, 257, 345

(56) References Cited

U.S. PATENT DOCUMENTS

| | | | |
|---|---|---|---|
| 4,749,196 | * | 6/1988 | Podgor . |
| 4,848,747 | | 7/1989 | Fujimura et al. . |
| 5,332,214 | * | 7/1994 | Tucker . |
| 5,332,223 | | 7/1994 | Johnson . |
| 5,425,535 | | 6/1995 | Gee . |
| 5,458,332 | | 10/1995 | Fisher . |
| 5,464,212 | | 11/1995 | Cook . |
| 5,575,472 | | 11/1996 | Magerman et al. . |
| 5,605,510 | | 2/1997 | Schmidt et al. . |
| 5,674,132 | | 10/1997 | Fisher . |
| 5,690,562 | | 11/1997 | Sturm . |
| 5,718,644 | * | 2/1998 | Donofrio . |
| 5,766,093 | | 6/1998 | Rohrer . |
| 5,842,935 | | 12/1998 | Nelson . |
| 5,938,543 | * | 8/1999 | McGeeney . |

* cited by examiner

*Primary Examiner*—Sebastiano Passaniti
(74) *Attorney, Agent, or Firm*—Antony C. Edwards

(57) ABSTRACT

The putter head of the present invention has an elastomeric core that provides resonant feedback having an amplitude corresponding to applied force. Te putter head includes a peripherally weighted body having a uniform first density. The body has a full depth cavity extending along a first axis from a planar front face of the body to a rear face of the body. The opposite ends of the cavity are exposed on the front and rear faces of the body. The cavity and the first axis are perpendicular to the front face of the body. An elastomeric core is mounted within the cavity so as to completely fill the cavity. The core is mounted solely by frictional adhesive engagement between an outer perimeter surface of the core and a surface of the cavity. The core has a uniform second density and opposite front and rear faces. The front face of the core is coplanar with the front face of the body.

12 Claims, 7 Drawing Sheets

PUTTER HEAD HAVING ELASTOMERIC CORE

CROSS REFERENCE TO RELATED APPLICATION

This application claims priority from United States Provisional Patent Application No. 60/127,615 filed Apr. 1, 1999 titled Putter Having Elastomeric Core.

FIELD OF THE INVENTION

The invention relates to a method and apparatus for securing, a core structure within a main putter body structure, secured only by its perimeter in relationship to the striking surface through the interface of the two materials.

BACKGROUND OF THE INVENTION

Mechanically intrusive fasteners to retain a core insert within a putter body adversely effect the feel, that is, the feedback that a golfer relies on in the use of the putter. The present invention is an improvement over the prior art wherein steps recesses, backing plates, slots, tabs, extensions, pins, rods, screws, or other fasteners or combinations thereof are used as the primary means of core insert retention in a putter body. These mechanisms are stress risers and of unnecessarily complicated design.

In the prior art, Applicant is aware of numerous attempts in the prior art to improve the field of golf clubs generally and putters particularly. As an example, the following United States patents deal with the use of resilient or otherwise different density inserts mountable into the striking face of a golf club: U.S. Pat. No. 5,690,562 issued to Sturm on Nov. 25, 1997,for Soft Impact Putter; U.S. Pat. No. 5,674,132 issued to Fisher on Oct. 7, 1997,for Golf Club Head with Rebound Control Insert; U.S. Pat. No. 5,575,472 issued to Magerman et al on Nov. 19, 1996, for Golf Putter Head Having Face Insert and Method of Forming the Same; U.S. Pat. No. 5,605,510 issued to Schmidt et al on Feb. 25, 1997, for Golf Putter with Face Plate Insert; U.S. Pat. No. 5,842,935 issued to Nelson on Dec. 1, 1998,for Golf Putter Head With Low Density Insert; U.S. Pat. No. 5,458,332 issued to Fisher on Oct. 17, 1995, for Golf Putter Head with a Cushioning Face; U.S. Pat. No. 5,464,212 issued to Cook on Nov. 7, 1995, for Golf Club Putter; U.S. Pat. No. 5,766,093 issued to Rohrer on Jun. 16, 1998, for Golf Putterhead; U.S. Pat. No. 5,807,189 issued to Martin et al on Sep. 15, 1998, for Golf Club Head; U.S. Pat. No. 4,848,747 issued to Fujimura et al on Jul. 18, 1989, for Set of Golf Clubs.

For the reasons better set out below, such inserts are inferior to the full depth elastomeric core insert of the present invention.

Applicant is also aware in the prior art of two United States patents, also disclosing inserts for use in golf club heads wherein the insert is interior to the golf club head, namely: U.S. Pat. No. 5,820,481 issued to Raudman on Oct. 13, 1998, for Golf Putter; and U.S. Pat. No. 5,425,535 issued to Gee on Jun. 20, 1995, for Polymer Filled Perimeter Weighted Golf Clubs.

Applicant is aware of one United States patent, namely, U.S. Pat. No. 5,332,223 which issued Jul. 26, 1994 to Johnson for a Golf Club Putter and Method of Manufacture, which teaches the use of an insert which extends from the striking face of the putter to the rear face of the putter and is peripherally contained within a peripherally weighted putter head. In particular, the putter head of Johnson is formed by bending a rod of suitable rigid material, such as stainless steel, into a desired head shape thereby defining an enclosed open area into which a striking face insert is installed and permanently held in place with a suitable adhesive filler material such as a polyester fiberglass resin. What is neither taught nor suggested, and which is an object of the present invention to provide, is the mounting of a full depth elastomeric core into a peripherally weighted putter head without the requirement of either adhesive filler material such as taught by Johnson, or other mechanical fastening means such as taught in the above cited prior art.

SUMMARY

In summary the putter head of the present invention has an elastomeric core that provides resonant feedback having an amplitude corresponding to applied force. The putter head includes a peripherally weighted body having a uniform first density. The body has a full depth cavity extending along a first axis from a planar front face of the body to a rear face of the body. The opposite ends of the cavity are exposed on the front and rear faces of the body. The cavity and the first axis are perpendicular to the front face of the body. An elastomeric core is mounted within the cavity so as to completely fill the cavity. The core is mounted solely by frictional adhesive engagement between an outer perimeter surface of the core and a surface of the cavity. The core has a uniform second density and opposite front and rear faces. The front face of the core is coplanar with the front face of the body.

The outer perimeter surface of the core and the surface of the cavity are free from asymmetric irregularities. The second density is substantially less than the first density. For example, the first density may be nine times the second density. The core is, in cross section perpendicular to the first axis, symmetric about orthogonal second and third axes lying in the cross section. The core dampens sound vibration commensurate with an applied force resulting from direct impact of the front face of the core with a golf ball, and redirects the force radially, orthogonal to the first axis, into the peripherally weighted body for transmission of the force by the body as tactile and audible feedback to a user. The feedback has an amplitude corresponding to a magnitude of the transmitted force. The feedback produced by the body after a golf ball impacts the front face of the core indicates the force of the impact independently of the hardness of the composition of the golf ball.

Advantageously, the cavity is elongate along the second axis and the second axis is a longitudinal axis of the body. Further, the cavity may be positioned above a lowermost surface of the body so as to contact a golf ball lying in grass.

In one aspect of the present invention, the diameter of the cavity, measured in a plane containing the second and third axes, may not be constant along the first axis. That is, the core is not merely a truncated cylindrical elastomeric plug but may be a truncated ellipsoid or truncated spheroid (including oblate or prolate), in which cases the diameter of the cavity increases inwardly of the front and rear core faces. In one embodiment the diameter of the cavity is a maximum at a position generally halfway between the front and rear core faces along the first axis. The surface of the cavity may also be formed as a bi-directional wedge shape. In other embodiments, the diameter of the cavity may decrease inwardly of the front and rear faces so as to assist in holing the core in the cavity.

In the case where the core is a truncated ellipsoid or spheroid the surface profile of the front face of the core may be elliptical, round or otherwise generally oval. Thus a surface profile of the front face of the core is symmetric about at least one of the second or third axes. The putter head of claim 9 wherein the surface profile is elliptical. In a further aspect of the present invention a long axis of the surface profile is parallel to a long axis of the body.

DETAILED DESCRIPTION OF PREFERRED EMBODIMENTS

Figure 1:
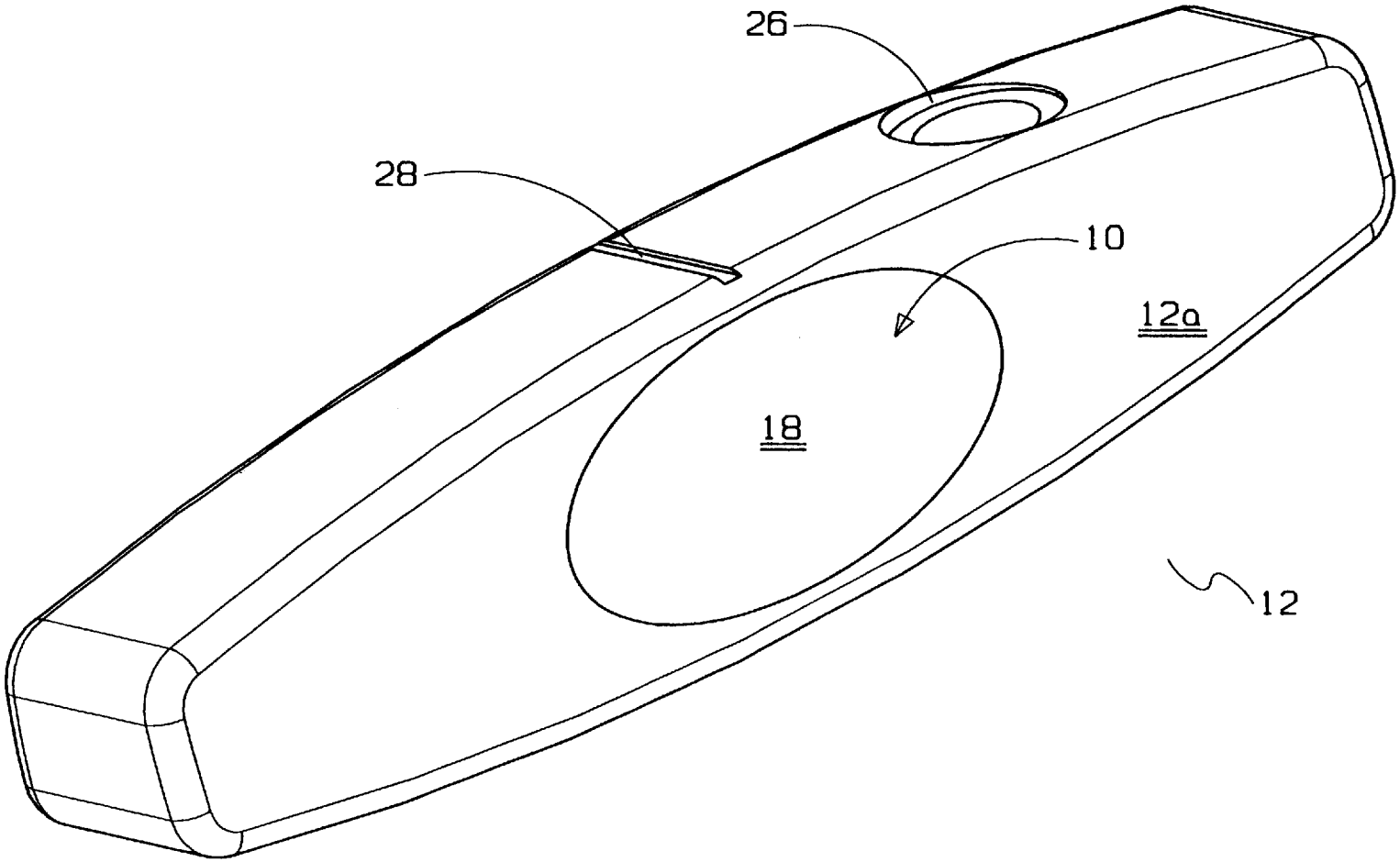
FIG. 1 is, in perspective view, a first embodiment of the putter head of the present invention.
Figure 2:
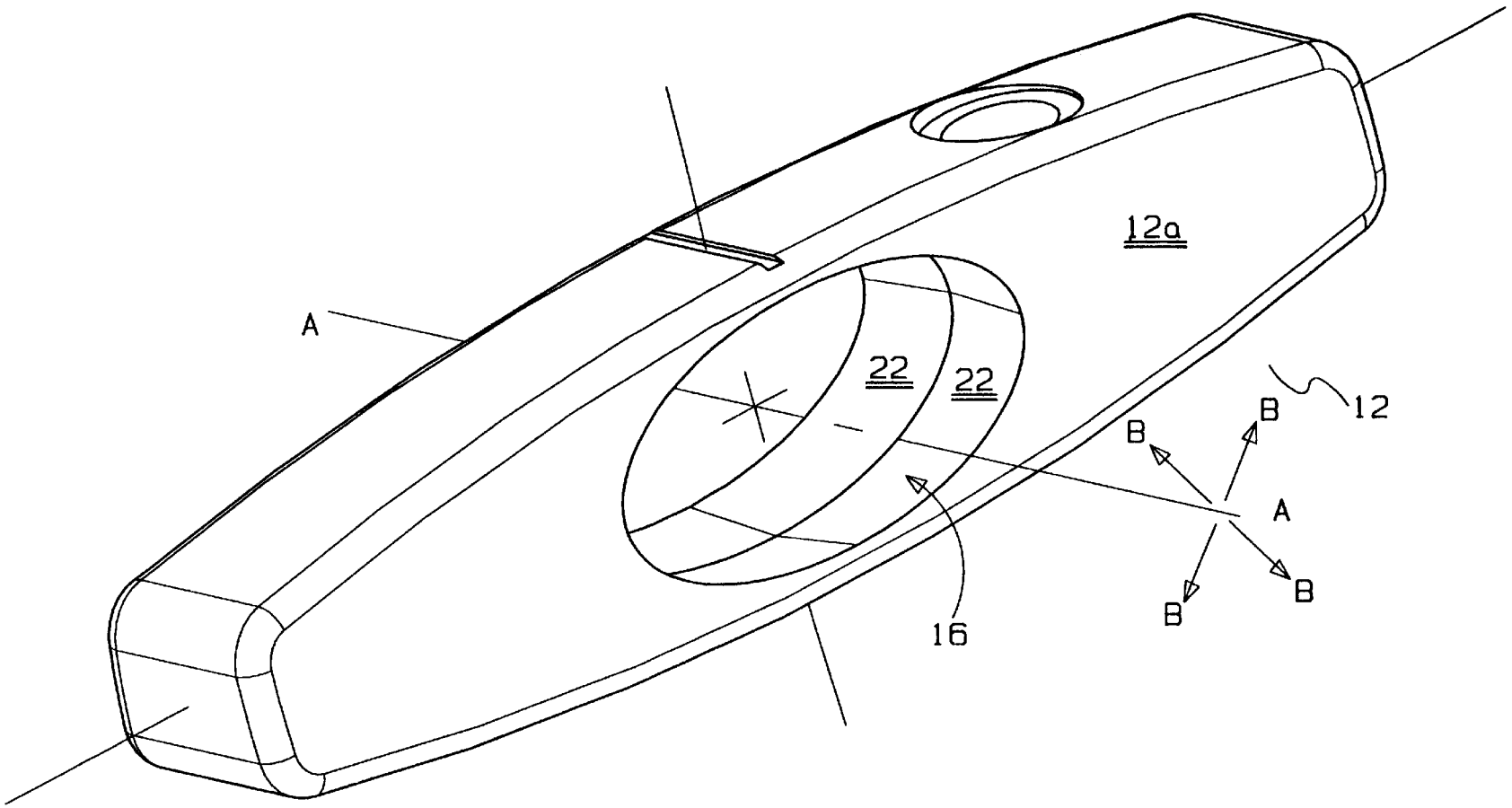
FIG. 2 is the putter head of FIG. 1 with the elastomeric core removed.
Figure 3:
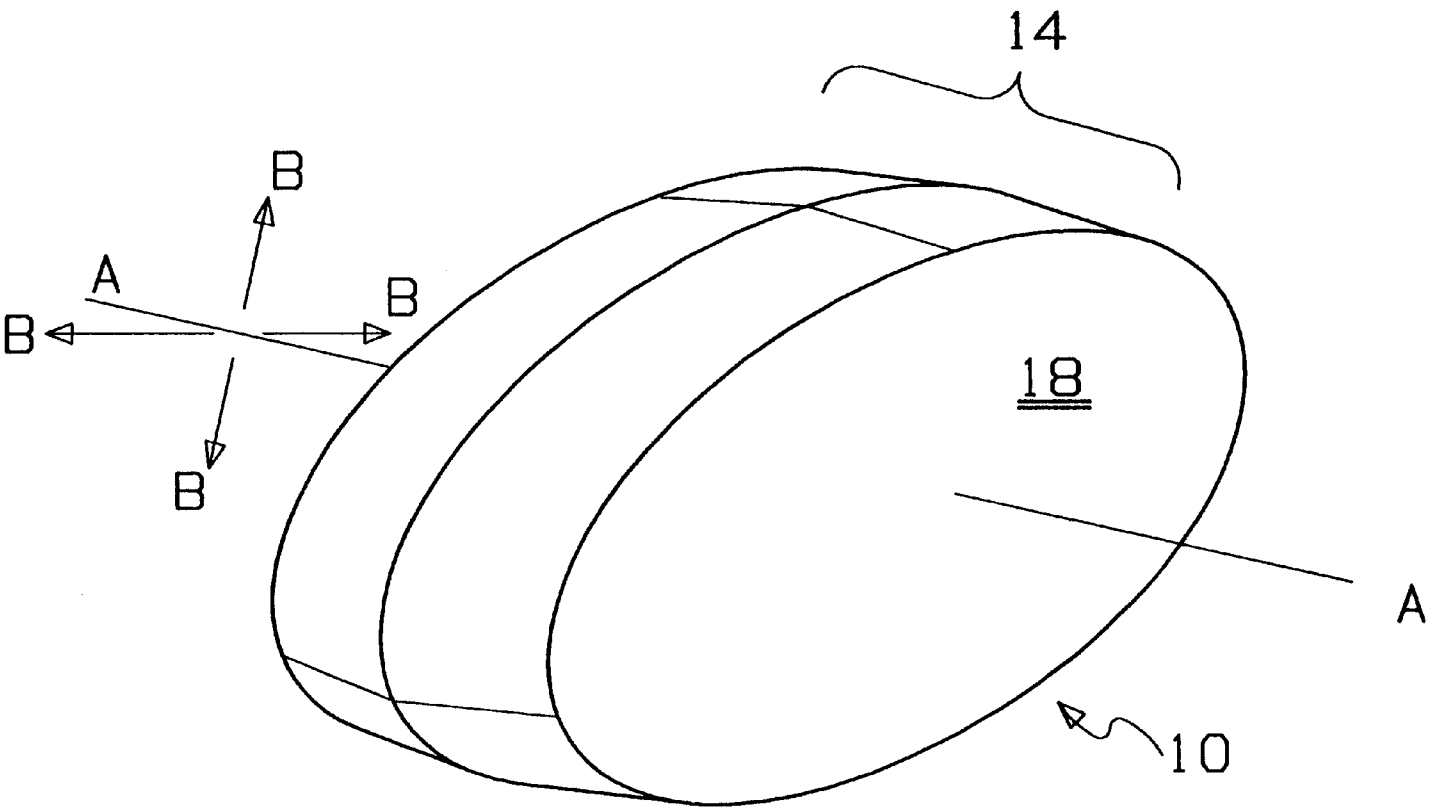
FIG. 3 is, in perspective view, the elastomeric core of FIG. 1.
Figure 4:
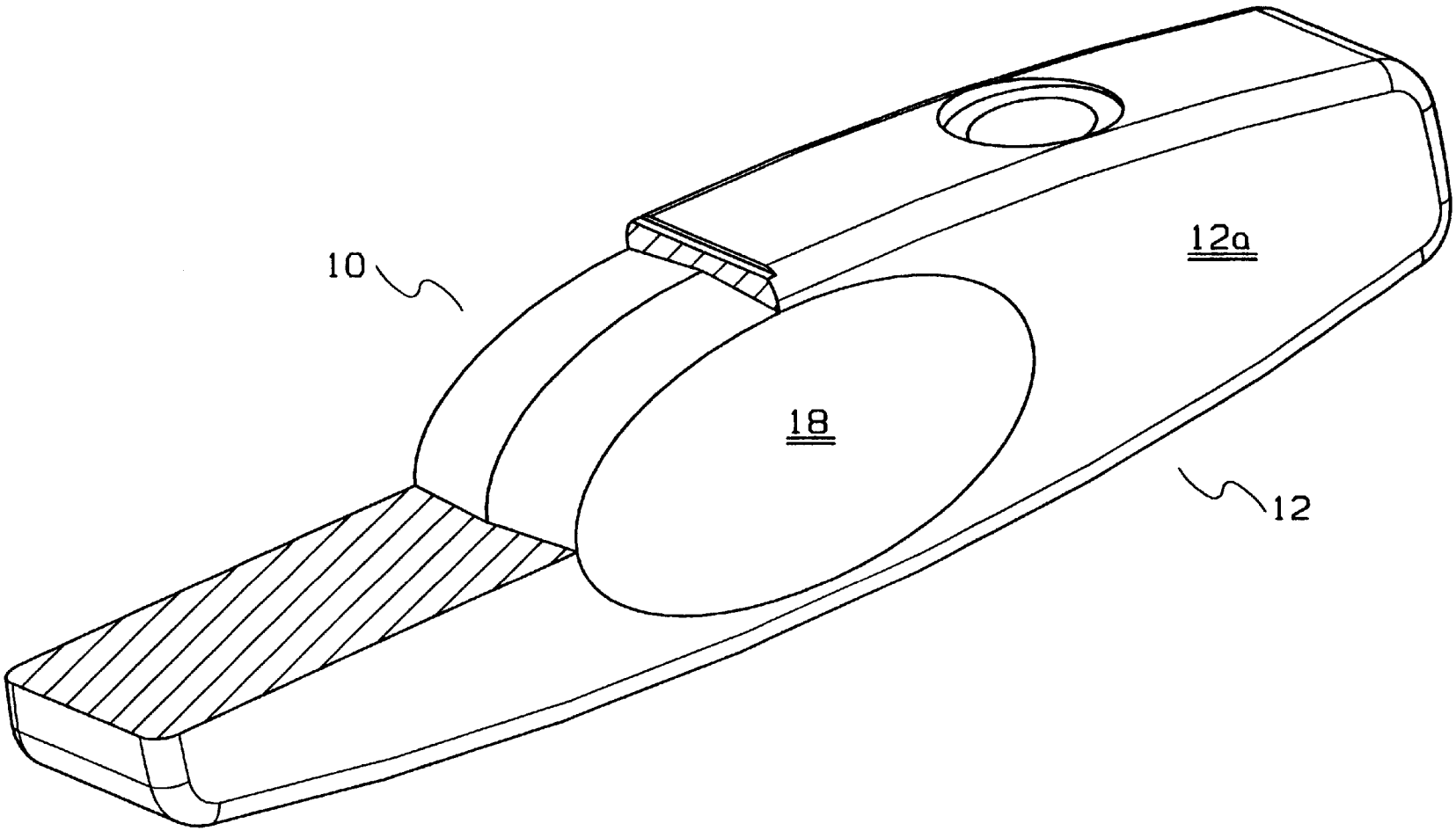
FIG. 4 is the putter head of FIG. 1 partially cut away to expose the elastomeric core.

The putter head of the present invention includes a central core material 10 and a putter body material 12 each having a different density. As seen in FIGS. 1–5,core material 10 is surrounded around its perimeter by putter body material 12. Perimeter surface 14 of core 10 is frictionally mated within cavity 16 in putter body 12. The core profile of core 10 is the shape of the core exposed on opposite faces 18 and 20 of the putter. Face 18 provides the preferred ball impact region or zone on the five putter designs illustrated in FIGS. 6*a*–6*e*, namely, the blade, flange, mallet, cavity, and long-putter designs respectively. The blade design of FIGS. 1–5 and 6*a*, being symmetric also has a preferred ball impact region or zone on face 20. Core 10 is advantageously symmetric in its cross sectional shape when viewed in cross section perpendicular to its longitudinal axis A—A extending through the body of the putter. Further advantageously, the cross sectional shape of core 10 is defined by its exposed portion on front face 18 and opposite rear face 20.

The blade design putter has two, i.e., front and rear, opposite striking surfaces 12*a* and 12*b*. Core 10 has exposed front and rear surfaces 18 and 20 on both front and rear striking surfaces 12*a* and 12*b*. The exposed portions are advantageously identical in dimension and profile, providing that both front and rear striking faces are identical in profile and are equal in degree of loft in accordance with USGA rules defining putter heads.

Core 10 is secured and located in the putter body cavity 16 only by the perimeter of its structure, that is, perimeter surface 14.

The preferred method of securing and locating core 10 within cavity 16 is to cast the core using a material that is available in liquid form and that sets with a resulting desired durometer or hardness value within the core cavity in the putter body. Thus the outer perimeter surface 14 of the core forms a conformal and tightly fit interface adhering with the surrounding surface of the putter body core cavity 16. The casting of the core may take place prior to the final defining (for example, machining) of the putter head as better described below.

Figure 5:
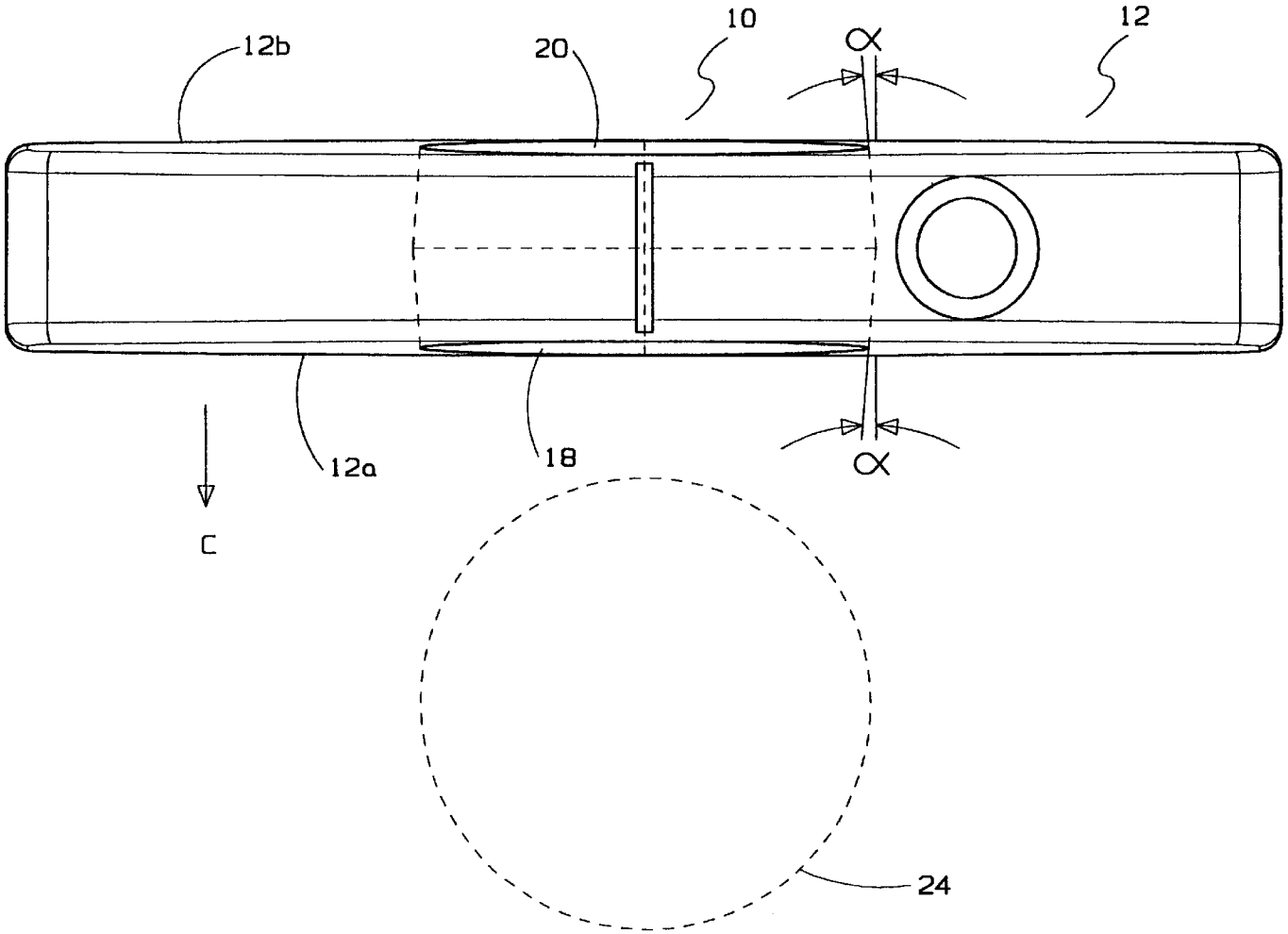
FIG. 5 is, in plan view, the putter head of FIG. 1.
Figure 6A:
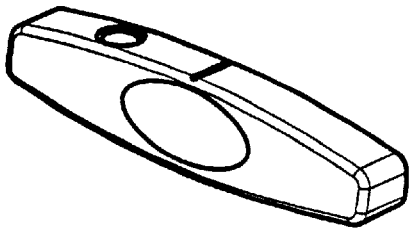
FIG. 6*a* is, in perspective view, a putter head of the present invention having a shape designated herein as a blade design.
Figure 6B:
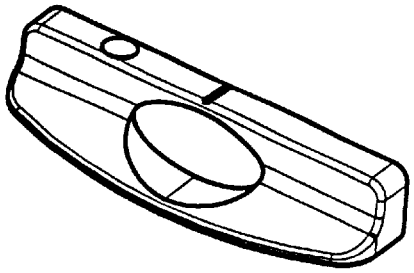
FIG. 6*b* is, in perspective view, a putter head of the present invention having ;a shape designated herein as a flange design.
Figure 6C:
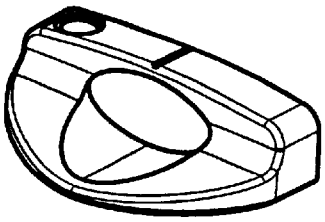
FIG. 6*c* is, in perspective view, a putter head of the present invention having a shape designated herein as a mallet design.
Figure 6D:
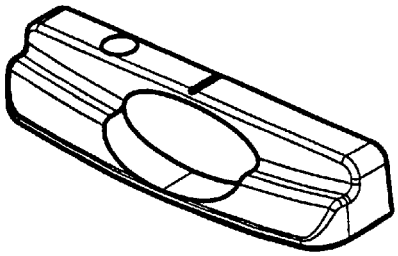
FIG. 6*d* is, in perspective view, a putter head of the present invention having a shape designated herein as a cavity design.
Figure 6E:
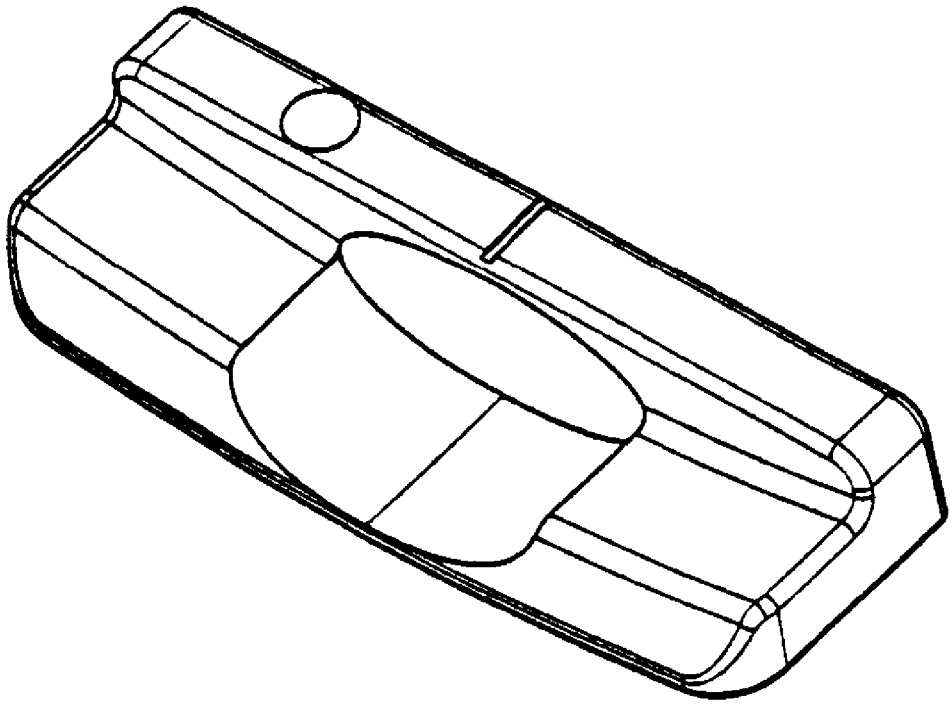
FIG. 6*e* is, in perspective view, a putter head of the present invention having a shape designated herein as a long putter design.

In a preferred embodiment retention of core 10 within cavity 16 is additionally provided through the use of symmetric draft angles a forming a bi-directional wedge-shape as seen defined in FIG. 5.

The core material is preferably a polyurethane composition. The preferred putter body material is a metallic composition as better set out below and set out by way of example using brass in Table 1. The preferred core material has a density that is preferably, although not intended to be limiting, 9 times less dense than that of the surrounding putter body structure. In addition, because there are no uneven surfaces, intrusions, or irregularities to the core and because the core is less dense than the surrounding body, the putter head of the present invention provides for a pure form of perimeter weighting. During off-center strikes, perimeter weighting has been proven to reduce the angle of deflection of the club head thereby increasing the probability of the golf ball staying on the intended path.

Alternatively, if the selected core material is of viscous liquid when heated, or solid form, the surrounding body may be either cast around the core, or the core may be pressed into the body cavity, or retention may be provided through the expansion or contraction of chosen materials when subjected to differing heat ranges, or through any combination of these, or through any means by which the core is secured in the core cavity only by an outer perimeter surface 14 which is smooth and free of asymmetric irregularities such as tabs, pockets, recesses or the like which may assist in securing the core within the cavity. In the present invention the perimeter surface 14 may be symmetrically contoured such as by the bi-directional wedge shape, or by smooth or symmetric curvature or other shapes so as to provide a smooth symmetric perimeter locking interface.

The present invention relates to the improved interaction between the core material and the surrounding putter body caused by striking a golf ball, it being understood that the putter head is mounted, for example by means of threaded bore 26,at the distal end of a putter shaft. The interaction dampens, absorbs, and disperses transmitted vibrations or resonating frequencies caused by striking a golf ball 24 and improves the feel or feed-back to a user following a strike of a ball against either of faces 18 or 20.

In the present invention, golf ball 24 is struck by translating the putter head in direction C. Impact forces are dampened and transferred radially relative to axis A, that is, in directions B perpendicular to axis A from core perimeter surface 14 through the interface surface 22 of cavity 16 to the surrounding putter body. The result is that, should the putter face strike the golf ball outside of the preferred strike regions of faces 18 or 20,the dampening effect is diminished when compared with striking the golf ball within the preferred region. It is the reduction of vibrations and or resonating frequencies afforded through radial dampening and the resultant improved ball response and sound made by the strike that results in what golfers describe as a "softer feeling" putter.

Feel, as relating to golf, can be described as the resonance or vibrations audibly transmitted to the golfer, and tactilely transmitted through the shaft and grip to the golfer's hands, caused by impact between the club face, golf ball, and in some instances the turf or other foreign obstacles. Feel may further be described as a flexation or twisting torque applied to the shaft during the swing or putting stroke at any point including impact. Feel, in other words, is the feedback to the golfer whether auditory or tactile.

The core 10 of the present invention communicates with the surrounding body 12 of the putter in an evenly radially distributed fashion through its perimeter or outer surface 14 at interface surface 22. This better communicates to the golfer information about how golf ball 24 was struck. This allows the golfer to make the necessary adjustments to improve his or her putting stroke.

It has been the applicant's observation that both core face profile and its depth, i.e. the dimension along axis A between the front and rear faces, respectively affect both the pitch and the amplification of the tone produced by the striking of the golf ball.

A profile of core face 18 having a smaller circumference produces a sound of higher pitch when compared to a profile having a larger circumference, if the depth remains constant. As the relative depth of the cavity is increased a corresponding decrease in tonal amplification (volume) is observed. The putterhead audibly interprets the relative force applied during the putting stroke while simultaneously being less sensitive to changes in golf ball composition, this provides for greatly enhanced distance control. That is, a golfer can putt with very different golf balls, but feels the same when hit the same distance possibly due to dampening of a direct ball generated sound which is governed by ball composition allowing the force alone of the hit to generate sound from ringing of the body once the force has been transmitted through the core. This way, a golfer knows how hard he is hitting the ball no matter what type of ball (hard or soft) he is using. This provides for consistency of play.

It has been applicant's further observation that the feedback, especially the audible feedback received by a golfer, may result in a golfer over-compensating when the audible feedback is in the nature of a "crack" sound. A "crack" sound normally means to a golfer that too much force has been applied. The resulting over-compensation results of the golfer being afraid to hit the ball, and quite often results in upsetting the practiced muscle coordination and consequentially the missing of the putt. In the present invention, the radially distributed dampening of the central resilient core, combined with the fact that the core extends the entire depth of the putter head, means that the resultant force of striking the ball is directed through the putter head parallel to axis A without rebound or reflection of the transmitted force from any rigid backing, mounting plate or other protrusion which would adversely affect the dampening and soft feel afforded by a putter having a putter head of the present invention mounted thereto. The putter head of the present invention by reason of its elegantly simplified structure improves the feel of striking any golf ball as a result of the putter head producing a softer sound without eliminating all feedback entirely. Some feedback is required to indicate to the golfer the point of contact on the face of the putter head and to also indicate to the golfer the relative swing weight applied in the stroke and the dwell time, as it is so-called, of the golf ball striking the preferred region of the putter head.

The use by applicant of a fully bored cavity having a resilient core allows the putter head to have true perimeter weighting of the head which improves the head balance and makes the head therefore more forgiving by reducing the tendency of the head to twist. The resulting feel to the golfer is that the putter head has a larger "sweet spot". The perimeter weighted, fully bored resilient insert structure of the present invention results in a density map across the entire face of the putter head which has increased, but constant, density around the perimeter of cavity 16,and a reduced, yet constant, density across faces 18 and 20. The oval or elliptical or otherwise elongate cross-sectioned core 10 results in a corresponding match between the preferred region for striking a golf ball, that is, faces 18 and 20,and what applicant has observed to be the generally bell-shaped distribution of the number and position of points of striking between a putter head and a golf ball along the faces of the putter head. That is, with the core 10 positioned on the putter head so that axis A coincides with the point of desired striking of the golf ball, most golf ball strikes will fall within a region close to the desired point of strike, with the number of strikes occurring towards the elongate opposite ends of the putter head falling off in a distribution somewhat approximating a bell curve.

Although it is understood that a putter head of the present invention may be either right hand faced balance or left hand faced balance, it is understood that full 360 degree balancing allows for both left and right hand usage. However, the balancing of the head and the commensurate shaping of the putter shaft is not intended to be limiting of the present invention in any way in that the putter heads of the present invention allow for multiple shaft designs depending on the desired offset and balance preferred by a particular golfer.

In manufacturing the golf putter head of the present invention, it is an objective to integrate the core with the putter head body at interface surface 22 in a seamless fashion extending between the front and rear faces of the putter, instead of intrusively mechanically fastening the core into the putter head body or relying solely on the use of adhesives. The objective is to seamlessly mount the core within the body so as to obtain an evenly distributed energy dispersion from the core to the body upon the striking of the golf ball in the preferred region. The core is solely frictionally adhered into the body (given that a cast core is to adhere to the core walls and a mechanically inserted core may have to have additional adhesive used).

Consequently, it is understood that the putter head may, without intending to be limiting, be made of brass, steel, aluminum, titanium, copper, aluminum-bronze, beryllium-composition, carbon-composition or like metallic materials so long as a resilient core may be mounted into cavity 16 for example according to the method next described.

In one preferred method, a polyurethane elastomer having adhesive properties for adhering to the material of body 12 core is poured into cavity 16 in a vacuum chamber so as to avoid the formation of bubbles. Cavity 16 has been milled or cast to have a non-polished interior surface. The core shrinks as it hardens within cavity 16. In order to avoid a poor fit then of core 10 within cavity 16, putter body 12, which at this point in the method may not yet be in its final or finished form, is preheated so as to make cavity 16 larger. As core 10 cools, it hardens and adheres to the interior surface of the cavity. Advantageously the elastomer of which core 10 is made, is poured at the same temperature at which putter body 12 is heated to. It has been applicant's experience that this method has worked when the material of putter body 12 is metallic. By this method applicant has found that the differential shrinkage rate of core 10 approximates somewhat the shrinkage rate of cavity 16 as both core 10 and putter body 12 cool. The objective is that, as the materials cool, air is not drawn into the interface between interface surface 22 and core 10. Advantageously, extra metallic material is left on the face of putter body 12 so as to form a deeper cavity 16. Once core 10 has been poured and cooled the resulting uneven exposed surface of core 10 may be milled flat at the same time as the extra face material on putter body 12 is milled off.

Alignment mark 28 is provided for the convenience of the golfer to assist in indicating to the golfer the alignment of axis A with the golf ball, alignment mark 28 being parallel to, and vertically disposed above, axis A. It is understood that the relative vertical positioning of axis A relative to putter body 12 is such that axis A coincides with the point of striking of a golf ball given the normally anticipated settled depth of a golf ball sitting on a putting green, and the normal anticipated height above the golf putting green that the bottom-most surface of putter body 12 passes during an optimized putting stroke.

TABLE 1

| | | |
|---|---|---|
| Density: | | |
| Elastomer | 15.37 | grams/cu. in. |
| Brass | 139.25 | grams/cu. in |
| Cavity Volume: | | |
| blade (FIG. 6a) | 0.8254 | cu. in. |
| flange (FIG. 6b) | 0.59605 | cu. in. |
| mallet (FIG. 6c) | 0.8240 | cu. in. |
| cavity (FIG. 6d) | 0.68328 | cu. in. |
| long putter (FIG. 6e) | 0.68328 | cu. in. |

| Model | Weight of Brass only | Weight of Elastomer only | Total Weight: Brass and Elastomer | % perimeter (Brass/total) |
|---|---|---|---|---|
| Blade | 318.2 gm | 12.69 gm | 330.89 b gm | 96.2 |
| Flange | 326.1 | 9.16 | 335.26 | 97.2 |
| Mallet | 330.0 | 12.60 | 342.60 | 96.3 |
| Cavity | 329.0 | 10.5 | 339.50 | 96.9 |
| Long Putter | 454.0 | 10.5 | 464.50 | 97.7 |

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A putter head having an elastomeric core that provides resonant feedback having an amplitude corresponding to applied force, comprising:

a peripherally weighted body having a uniform first density, said body having a full depth cavity extending along a first axis from a planar front face of said body to a rear face of said body so as to expose opposite ends of said cavity on, respectively, said front and rear faces of said body, said cavity and said first axis perpendicular to said front face of said body, an elastomeric core mounted within said cavity so as to completely fill said cavity, said core mounted solely by frictional adhesive engagement between an outer perimeter surface of said core and a surface of said cavity, said core having a uniform second density, said core having opposite front and rear faces, said front face of said core coplanar with said front face of said body, wherein said outer perimeter surface of said core and said surface of said cavity are free from asymmetric irregularities, wherein said second density is substantially less than said first density, wherein said core is, in cross section perpendicular to said first axis, symmetric about orthogonal second and third axes lying in said cross section, and wherein said core dampens sound vibration commensurate with an applied force resulting from direct impact of said front face of said core with a golf ball, and redirects said force radially, orthogonal to said first axis, into said peripherally weighted body for transmission of said force by said body as tactile and audible feedback to a user, said feedback having an amplitude corresponding to a magnitude of said transmitted force, wherein said feedback produced by said body after a golf ball impacts said front face of said core indicates the force of the impact independently of the hardness of the composition of the golf ball.

2. The putter head of claim 1 wherein said cavity is elongate along said second axis, and wherein said second axis is a longitudinal axis of said body.

3. The putter head of claim 2 wherein said cavity is positioned above a lowermost surface of said body so as to contact a golf ball lying in grass.

4. The putter head of claim 2 wherein the diameter of said cavity, measured in a plane containing said second and third axes, is not constant along said first axis.

5. The putter head of claim 4 wherein said diameter of said cavity increases inwardly of said front and rear core faces.

6. The putter head of claim 5 wherein said diameter of said cavity is a maximum at a position generally halfway between said front and rear core faces along said first axis.

7. The putter head of claim 1 wherein said second density is nine times greater than said first density.

8. The putter head of claim 1 wherein said surface of said cavity is formed as a bi-directional wedge shape.

9. The putter head of claim 1 wherein a surface profile of said front face of said core is generally oval.

10. The putter head of claim 9 wherein said surface profile is elliptical.

11. The putter head of claim 9 wherein a long axis of said surface profile is parallel to a long axis of said body.

12. The putter head of claim 1 wherein a surface profile of said front face of said core is symmetric about at least one of said second or third axes.

* * * * *